US010443922B2

(12) United States Patent
Jackmann et al.

(10) Patent No.: US 10,443,922 B2
(45) Date of Patent: Oct. 15, 2019

(54) HEAT EXCHANGE SYSTEM, DEFROSTING DEVICE, FAN, HEAT EXCHANGER, HOUSING, AND USE OF A HEATING VARNISH

(71) Applicant: GÜNTNER GMBH & CO. KG, Fürstenfeldbruck (DE)

(72) Inventors: Heinz Jackmann, Lüdersburg (DE); Wolfgang Nohava, Guntramsdorf (AT)

(73) Assignee: GÜNTNER GMBH & CO. KG, Fürstenfeldbruck (DE)

( * ) Notice: Subject to any disclaimer, the term of this patent is extended or adjusted under 35 U.S.C. 154(b) by 24 days.

(21) Appl. No.: 15/529,739

(22) PCT Filed: Dec. 8, 2015

(86) PCT No.: PCT/EP2015/078991
§ 371 (c)(1),
(2) Date: May 25, 2017

(87) PCT Pub. No.: WO2016/091883
PCT Pub. Date: Jun. 16, 2016

(65) Prior Publication Data

US 2017/0321951 A1 Nov. 9, 2017

(30) Foreign Application Priority Data

Dec. 10, 2014 (EP) ..... 14197180

(51) Int. Cl.
*F25D 21/08* (2006.01)
*F28F 17/00* (2006.01)

(52) U.S. Cl.
CPC ..... *F25D 21/08* (2013.01); *F28F 17/00* (2013.01); *F28F 2245/00* (2013.01); *H05B 2203/013* (2013.01)

(58) Field of Classification Search
CPC ..... F25D 21/08; F25D 17/067; F28F 17/00; H05B 3/20; H05B 2214/02; Y10T 29/49083; F25B 39/024
See application file for complete search history.

(56) References Cited

U.S. PATENT DOCUMENTS 3,038,772 A * 6/1962 Schafer ..... F25D 21/14 312/229
5,433,086 A * 7/1995 Cho ..... F25D 17/065 62/455

(Continued)

FOREIGN PATENT DOCUMENTS

DE 102011006248 A1 10/2012
DE 102011006265 A1 * 10/2012 ..... F25D 17/067

(Continued)

OTHER PUBLICATIONS

International Search Report dated Feb. 7, 2016 in corresponding International Application No. PCT/EP2015/078991, filed Dec. 8, 2015 (with English Translation).

*Primary Examiner* — Frantz F Jules
*Assistant Examiner* — Martha Tadesse
(74) *Attorney, Agent, or Firm* — Global IP Counselors, LLP

(57) ABSTRACT

A heat exchange system includes a heat exchanger configured to exchange heat between a transport fluid and a heat transfer fluid, a fan configured and arranged such that the transport fluid is capable of being transported through the heat exchanger, a defrosting device configured to defrost a layer of frost, and a housing at which at least the heat exchanger and the fan are arranged, a heating lacquer layer arranged on at least one of the heat exchanger, the fan, the defrosting device, and the housing, the heating lacquer layer being electrically connected to a contact device for electrical contact with the heating lacquer layer, and when the layer of (Continued)

frost is on at least one of the heat exchanger, the fan, the defrosting device, and the housing, the layer of frost is able to be defrosted in an operating state of the heating lacquer layer.

19 Claims, 3 Drawing Sheets

(56) References Cited

U.S. PATENT DOCUMENTS

| | | | | |
|---|---|---|---|---|
| 2004/0109853 | A1* | 6/2004 | McDaniel | A62D 3/02<br>424/94.6 |
| 2008/0196429 | A1 | 8/2008 | Petrenko et al. | |
| 2010/0096507 | A1* | 4/2010 | Villinger | B60L 1/02<br>244/134 D |
| 2011/0014449 | A1* | 1/2011 | Mussig | C09J 7/243<br>428/220 |

FOREIGN PATENT DOCUMENTS

| | | | | | |
|---|---|---|---|---|---|
| DE | 102011006265 | A1 | * | 10/2012 | F25D 17/067 |
| GB | 917055 | A | * | 1/1963 | F25B 39/024 |
| GB | 917055 | A | * | 1/1963 | F25B 39/024 |
| KR | 20010094016 | A | | 10/2001 | |

* cited by examiner

HEAT EXCHANGE SYSTEM, DEFROSTING DEVICE, FAN, HEAT EXCHANGER, HOUSING, AND USE OF A HEATING VARNISH

CROSS-REFERENCE TO RELATED APPLICATIONS

This application is a U.S. National Stage application of International Application No. PCT/EP2015/078991, filed Dec. 8, 2015, which claims priority to European Patent Application No. 14197180.4, filed Dec. 10, 2014 the contents of each of which are hereby incorporated herein by reference.

BACKGROUND

Field of Invention

The invention relates to a heat exchange system 1, to a defrosting device, to a fan, to a heat exchanger, to a housing, and to the use of a heating lacquer.

Background Information

Heat exchange systems are already known and can be found in a plurality of technical applications. Heat exchange systems are used in refrigeration systems such as in common domestic refrigerators, in air-conditioning systems for buildings or in vehicles of all kinds, in particular in motor vehicles, aircraft and ships, as water coolers or as oil coolers in internal combustion engines, as condensers or evaporators in refrigerant circuits and in further innumerable different applications which are all well-known to the person of ordinary skill in the art.

FIG. 1 shows a heat exchange system 1 known from the prior art comprising the following basic components, a heat exchanger 2 having pipes and fins (not shown); a fan 3; a housing 5; and a defrosting device 4 having a first pan 46 and a second pan 44 and having a first outflow 45 and a second outflow 43. The first pan 46 can in this respect be arranged in the second pan 44. The heat exchange system 1 can be fastened to a wall or to a ceiling by a suspension 9. The heat exchanger 2 is in this respect connected to a circuit that includes a heat transfer fluid, i.e. a heat transfer medium, for example a coolant. The heat transfer fluid can in this respect be a coolant, water, water with glycol or a gas, for example ammonia or CO2. The transport fluid outside the heat exchanger 2 can, for example, simply be the environmental air and can take up heat energy from the heat exchanger 2 or can transfer it to the heat exchanger 2; that is, it is in this respect either correspondingly heated or cooled. The transport fluid has a substantially lower heat transfer coefficient than the heat transfer fluid circulating in the heat exchanger 2. In the operating state, the fan 3 transports the transport fluid through the heat exchanger 2. If the transport fluid, for example air, is cooled by the heat transfer fluid, moisture separation can occur by which water droplets form at the surface of the heat exchanger 2 that flow off in the form of condensed water in the direction of the defrosting device 4. The condensed water is collected by the first pan 46. The first pan 46 has a slope so that the condensed water is conducted in the direction of the first outflow 45. The condensed water collects there and is led off into a drain line via a second outflow 43 of the second pan 44. The second pan 44 as a rule only takes up the condensed water of the basic components that are at room temperature and leads it off via the second outflow 43. There is an air space between the first pan and the second pan 46, 44 and that makes provision that a first surface temperature of the first pan 46 approximately corresponds to a temperature of the condensed water, that is approximately corresponds to a temperature of the heat transfer medium, whereas a second surface temperature of the second pan 44 approximately corresponds to the room temperature. It is prevented by one or more connection parts of a non-heat conductive material between the first pan 46 and the second pan 44 that the second pan 44 cools too much and that condensed water forms at an outer side of the second pan 44 that could drip in an uncontrolled manner into a space, for example. If the heat exchange system 1 is used for a cooling of the room temperature to 0° C. and lower, the condensed water separated from the transport fluid freezes on the heat exchange system 1, in particular on one or more basic components. A layer of frost is thereby created on the heat exchange system 1, in particular on the pipes and fins of the heat exchanger 2, with the layer of frost being built up over a longer operating period to form a layer of frost having a growing frost thickness. A power loss of the heat exchange system 1 is thereby caused and an economic mode of operation is no longer possible. The layer of frost is therefore defrosted at regular intervals to remove said layer of frost from such a heat exchange system 1 at room temperatures of less than 0° C. The heat exchange system 1, in particular the basic components, is/are, for example, heated by an electric heater, a heating gas or a hot liquid for this purpose. This has the effect that the layer of frost dissolves off the heat exchange system 1 and flows off in the direction of the defrosting device 4, in particular into the first or second pan 46, 44, and has to be further melted there. The first pan 46 can likewise be heated for this purpose, which takes place, for example, using electrical heating bars or pipe coils 42 in which a hot gas or a hot liquid is located and which are fastened to an inner surface or outer surface of the first pan 46 by a fastening means 41 and which forward the heat to the inner pan 46. Another measure comprises insulating the second pan 44 against heat losses by a protective jacket. Heating films are also sometimes used to heat the heat exchange system 1, in particular the basic components, to avoid condensed water formation at the heat exchange system 1 due to a temperature increase or to defrost the layer of frost at the heat exchange system. Heating films can, for example, be films in a sandwich structure having inwardly disposed heating wires.

SUMMARY

It is a disadvantage with all known measures for heating the heat exchange system to prevent a formation of a layer of frost or with all known measures for defrosting the layer of frost at the heat exchange system that uneven heating takes place, in particular also at the first pan, and increased energy losses occur due to a poor heat transfer. On the use of pipe coils, there may additionally be leaks of the first pan caused, for example, by connection elements between the fastening means 41 for the pipe coil and the inner surface of the first pan 46. The disadvantage of the heating foil is likewise an uneven heating and the fact that the heating foil partly or wholly loses its function on damage to the heating wire. A further disadvantage is the complex surface structure with respect to demands on hygiene.

It is therefore an object of the present invention to propose a heat exchange system, a defrosting device, a fan, a heat exchanger, a housing and a use of a heating lacquer for producing a heating lacquer layer such that a layer of frost can be defrosted simply and/or inexpensively, in particular by a uniform heating of the heat exchange system and/or of the defrosting device and/or of the fan and/or of the heating exchanger and/or of the housing.

This object is satisfied by a heat exchanger described herein, by a defrosting device described herein1, by a fan described herein, by a heat exchanger described herein, by a housing described herein and by the use of a heating lacquer described herein.

A heat exchange system is proposed in accordance with the invention comprising the following basic components:

- a heat exchanger for exchanging heat between a transport fluid and a heat transfer fluid flowing through the heat exchanger;
- a fan that is configured and arranged such that the transport fluid can be transported through the heat exchanger;
- a defrosting device for defrosting a layer of frost; and
- a housing at which at least the heat exchanger and the fan are arranged. A heating lacquer layer is arranged on at least one of the basic components, wherein the heating lacquer layer is electrically connected to a contact device for the electrical contacting of the heating lacquer layer, and wherein the layer of frost on at least one of the basic components can be defrosted in the operating state of the heating lacquer layer.

The heat exchanger can be a heat exchanger with fins that can, for example, comprise a plurality of pipes for conducting through the heat transfer fluid and a plurality of fins. The fins can in this respect be connected to the pipes and are in communication with the transport fluid in operation. The fins can be arranged perpendicular to the pipes. The fins or pipes can be composed of a material with good heat conductivity, for example aluminum or copper, or stainless steel. The finned heat exchanger can naturally also include a plurality of pipes for more than one heat transfer medium or the pipes can be connected to one another in parallel and/or in series as required. A fin spacing, that is the spacing between two directly adjacent fins, can be >2 mm so that advantageously, in comparison with known heat exchange systems, the formation of the layer of frost has a smaller influence or hardly any influence on a flow rate of the transport fluid, preferably an air flow rate, and so that the heat exchanger can be defrosted more easily due to the smaller influence. The pipes can have one or more channels that can be flowed through by the heat transfer fluid. The pipes can, however, also be arranged in one strand or in multiple strands. The heat transfer fluid can flow through a plurality of pipes simultaneously. The heat exchanger per se can have a surface that can be flowed through of >0.3 $m^2$, preferably >0.5 $m^2$. The fins can be continuous and/or one or more pipes can be arranged at a fin; preferably, one or more pipes can be connected to a fin so that the fins advantageously have a large surface that can be defrosted. The heat exchanger can, however, also be a microchannel heat exchanger. The heat exchanger can be designed as a heat exchanger that has fins of a common form all over. The heat exchanger can be operated in a thermal power range of 0.5 kW to 2000 kW. The heat exchange system can furthermore have a high flow rate of the transport fluid, preferably an air flow rate, and/or of the heat transfer fluid and thus a greater power than known heat exchange systems, preferably a thermal power of >5 kW/h.

The heat exchange system can be configured as an evaporator or as a liquefier or as a dry cooler the evaporator can be arranged in a space, that is within a building, preferably in a walkable space. The evaporator can be configured as an air cooler for a butcher's, for example, or for process cooling and can preferably be arranged in a space. The dry cooler or liquefier can be arranged outside the building, that is preferably not in the space. The heat exchange system can comprise a defrosting device having a first pan and/or a second pan and having a first outflow and a second outflow. The defrosting device can be arranged inside or outside a building in which the heat exchanger can be arranged. The heat exchange system can be installed in the space in a construction aspect such that the heat exchange system cannot be removed without construction measures. The heat exchange system can; however, equally also be fastenable to the space, preferably to a wall or to the ceiling, by a fastening element that is preferably arranged at the housing. The heat exchange system can be configured without a circuit such that the transport fluid, preferably air, can be conducted directly out of the housing into the space, in particular laterally, that is in the direction of a side wall of the space, or downwardly, that is in the direction of a floor of the space.

The heat exchange system can comprise a compressor, wherein the compressor can be arranged within the building, in a further space, that is separately from the heat exchange system, for example in a machine room. The individual basic components and/or one or more heat exchange systems can be operatively connected, in particular flow-connected, by one or more connection lines, preferably pipes. The connection lines can in this respect be fixedly installed, for example mounted, in the space or in the building in which one or more heat exchange systems are arranged. The individual basic components and/or one or more heat exchange systems and/or the connection line can be connected to one another, preferably non-releasably connected; they can, however, in particular be in flow connection. The heat transfer fluid can be supplied to the heat exchange system, preferably after an installation of the heat exchange system. It may be necessary to train a specialist for the supply of the heat transfer fluid. The heat exchange system in accordance with the invention therefore substantially differs from a known refrigerator or from an air-conditioner for a space since the installation of the heat exchanger outside the building or inside the building, preferably in a space, can be complex and/or expensive, and in particular has to take place by a specialist, wherein the specialist preferably has to be trained for the installation and putting into operation of the heat exchange system.

The fan is configured and arranged such that the transport fluid can be transported through the heat exchanger. The fan can be arranged at a side wall or at a top or at a lower side of the housing. The fan can have a diameter of >315 mm, which has the advantage that the flow rate of the transport fluid is elevated.

The defrosting device for defrosting a layer of frost can comprise a first and/or a second pan and/or an air baffle and/or an insulation with a protective jacket. The first pan can be arranged in the second pan. The air baffle can be arranged in the first pan or in the second pan to avoid an air short-circuit between the heat exchanger and the first pan and/or the second pan. In addition, an insulation can be arranged at the first and/or second pans or between the first and second pans to insulate them against heat losses. The layer of frost can be understood as a layer of frozen water that comprises one, two or more sheets. The layer of frost can be composed of frozen water, in particular snow, ice or a mixed form of water and ice or snow.

At least the heat exchanger and the fan are arranged at the housing. The defrosting device can be arranged beneath the heat exchanger and/or housing in the direction of the outflowing, defrosting layer of frost to collect the layer of frost defrosting from the heat exchange system. The heat exchanger and/or the housing can thus be arranged within the defrosting device; the heat exchanger can in particular be arranged within the first pan and the first pan can encompass the heat exchanger and/or the housing can be arranged within the second pan and the second pan can encompass the heat exchanger. The housing can be composed of metal. In addition, the housing can have one or more nozzles and/or streamers so that a throwing range of the transport fluid can be increased.

It is important for the invention that a heating lacquer layer is arranged on at least one of the basic components, wherein the heating lacquer layer is electrically connected to a contact device for the electrical contacting of the heating lacquer layer, and wherein the layer of frost on at least one of the basic components can be defrosted in the operating state of the heating lacquer layer.

The heating lacquer layer can be arranged aerially or sectionally on one of the basic components of the heat exchange system;

- on the heat exchanger, in particular on one or more pipes or channels and/or fins of the heat exchanger; and/or
- on the housing, in particular on one or more side walls and/or on the top of the housing; and/or
- on the fan, in particular on a fan housing in which the fan is arranged and/or on an impeller of the fan; and/or
- on the defrosting device, in particular at the first pan and/or at the second pan, and/or on a first outflow and/or on a second outflow in that a heating lacquer is applied to the basic component, that is the basic component is coated. The heating lacquer layer can therefore be arranged on the basic component in that the heating lacquer is applied by a brush, by a spray gun, by lacquer rollers, by an automatic lacquering machine, by screen printing or by a dip process; or the application can take place by adhesive bonding of a carrier film having a heating lacquer layer arranged on the carrier film.

The heating lacquer layer is electrically connected to a contact device for the electrical contacting of the heating lacquer layer. An electric voltage can thus, for example, advantageously be applied to the heating lacquer layer by the contact device so that an electric current flows through the heating lacquer layer. This electric current can then be converted into heat. The heat can then be transferred in a targeted manner to one or more basic components by thermal conduction or in the form of heat radiation and the basic components can be heated or the layer of frost defrosted or the heat can be output to an environment in the form of heat radiation. The heat can thus be used in the operating state of the heating lacquer layer so that the layer of frost on one or more basic components can be defrosted. A very uniform heating of the basic component can be achieved or steered by varying the electric voltage or the surface or the thickness of the heating lacquer layer. Temperatures from 0° C. to 400° C. are thereby in particular advantageously achievable, wherein, for example, different voltages or voltage levels can be applied in the form of DC voltage or AC voltage.

The applied voltage preferably amounts to approximately 12 V or 24 V up to, for example, approximately 600 V. An existing electrical supply system to which the heating lacquer layer can be connected by the contact device can be provided for the energy supply.

Provision can equally be made that the electrical contacting of the heating lacquer layer comprises an arrangement of a contact device on one or more basic components, wherein the heating lacquer layer is at least partly also applied to the contact device for the electrical contacting. This therefore means, for example, that the contact device is applied directly and immediately to one or more basic components. The heating lacquer layer can then be applied to the contact device arranged in this manner and on a remaining free surface of the basic component. Provision can preferably alternatively made that the heating lacquer layer is first arranged on one or more basic components and that then the contact device is applied to the heating lacquer layer, with then a further heating lacquer layer being arranged on the contact device. Provision can, however, also equally be made that the electrical contacting of the heating lacquer layer comprises an arrangement of the contact device on the heat exchange system or on one or more basic components on which the heating lacquer layer is arranged. The contact device can be adhesively bonded and/or riveted and/or screwed and/or clamped and/or nailed to one or more basic components of the heat exchange system or to the heating lacquer layer respectively.

One or more areas of one or more basic components on which the heating lacquer layer is arranged can advantageously thus be evenly heated such that the layer of frost can be defrosted simpler and better and a non-uniform heating, for example hot spots, and increased energy losses due to a poor heat transfer as well as an increased vapor formation are avoided. In addition, work can be carried out with greater energy efficiency with smaller heating powers due to the high efficiency and a poor heat transfer is avoided. It is a further advantage that the heating lacquer layer has a positive coefficient of resistance/temperature coefficient and thus an electrical resistance does not rise on a heating of the heating lacquer layer so that a higher temperature of the heating lacquer layer is formed in a region in which, for example, the layer of frost lies on the heating lacquer layer than in a region of the heating lacquer layer that is free of ice and thus an automatic temperature compensation takes place on the heating lacquer layer. The heating lacquer layer furthermore has a high radiation portion in the operating state, whereby basic components and further components of the heat exchange system on which no heating lacquer layer is arranged are also heated by heat radiation. Complex surface structures, for example the first or second drain or a fan nozzle, can also be heated over the whole surface. It is moreover advantageous that, if a plurality of heat exchange systems are present, in particular air coolers, they can be defrosted individually. A cost reduction can ultimately advantageously be effected since components such as an electric heater, electric heating bars or pipe coils in which a hot gas or a hot liquid is located or heating films can in particular be dispensed with.

In an embodiment of the invention, the heating lacquer layer is electrically conductive, is free of carbon nanotubes and comprises a polymer and a semiconductor material. Since the electrically conductive heating lacquer layer is free of carbon nanotubes and furthermore comprises a polymer and a semiconductor material, a conversion of electric current can advantageously take place into heat that can be output by thermal conduction to a basic component or in the form of infrared radiation to an environment of the basic component. It is thereby furthermore advantageously made possible to heat the basic component or the environment without using the known systems for this purpose, which effects a considerable reduction in energy consumption.

In an embodiment of the invention, the polymer is acrylic, acrylic resin, epoxy resin, silicone or polyurethane. Provision can in particular be made that the heating lacquer layer comprises a plurality of different polymers that can, for example, be formed as one of the aforesaid polymers.

The heating lacquer layer furthermore comprises acrylic resin as the polymer and furthermore tetrasodium diphosphate, calcium carbonate and graphite having a weight percentage of graphite of less than or equal to 20%. This therefore in particular means that the heating lacquer layer comprises acrylic resin as the polymer and furthermore tetrasodium diphosphate, calcium carbonate and graphite having a weight percentage of graphite of less than or equal to 20. This therefore in particular means that the heating lacquer layer can be formed from an acrylic resin dispersion that can be charged with tetrasodium diphosphate and calcium carbonate or can comprise these components and can furthermore comprise up to 20% graphite. One or more binding agents are furthermore preferably admixed to this dispersion.

In an embodiment of the invention, the contact device comprises two electric conductors arranged next to one another, wherein the heating lacquer layer is at least partly arranged between the electric conductors. If an electric voltage is applied to the two electric conductors, an electric current advantageously flows through the heating lacquer layer from the one electric conductor to the other electric conductor along the length of the electric conductor. A heating lacquer layer can thus advantageously be electrically contacted simply and without any great technical effort over any desired length.

In an embodiment of the invention, the electric conductors comprise a wire, a braid, a metal mesh, a metal band, a metal film and/or a metal sheet. The conductors can preferably be adhesively bonded and/or riveted and/or screwed and/or clamped and/or nailed to the substrate. The conductors are preferably glued to the substrate by the heating lacquer layer.

Provision can be made in another embodiment that two electric conductors are each arranged at both sides of a surface of a basic component. This therefore in particular means that an electrically conductive hard lacquer layer can be arranged at both sides of the surface. A provided surface of one or more basic components can thus advantageously be used particularly efficiently. Each surface of the basic component can in particular be set individually by the individual contacting of the respective electric conductors.

In an embodiment of the invention, a protective layer, in particular an insulating lacquer, a glass fiber reinforced plastic and/or a protective film, are arranged on the heating lacquer layer. A mechanical protection for the heating lacquer layer is thereby advantageously effected such that the latter is advantageously protected against mechanical strains or external influences. In addition, a hygienic surface of the basic component can be achieved or the irradiation of the heat to the environment can be reduced or the irradiation of the heat to an oppositely disposed component can be directly controlled. An electrical insulation of the heating lacquer layer from the environment is in particular advantageously thereby achieved such that a risk of a short-circuit or a risk for a user can be avoided.

In an embodiment of the invention, a reflector layer for reflecting infrared radiation and/or an insulating layer for the thermal insulation is/are formed between the basic component and the heating lacquer layer. Provision can moreover be made that an electrical insulation layer is formed between the heat exchange system or one or more basic components and the heating lacquer layer. A reflection, a thermal insulation and/or an electric insulation between the heating lacquer layer and the heat exchange system or the basic component is thereby advantageously effected. In addition, such a reflector layer advantageously reflects the infrared radiation irradiated by the heating lacquer layer such that losses are advantageously reduced or avoided.

In an embodiment of the invention, a conductive layer is formed between the basic component and the heating lacquer layer for transferring the heat by thermal conduction and/or for electrical insulation. A conductive layer can therefore be applied between the basic component and the heating lacquer layer to advantageously improve the thermal conduction and/or to avoid the direct electrical contact of the heating lacquer layer with the basic component.

In an embodiment of the invention, a defrosting flap is configured as a basic component. The defrost flap can be configured as a unit of the heat exchange system; the housing can in particular comprise the defrosting flap. The defrosting flap can be arranged at the air inlet of the housing and can be closed during the defrosting in the operating state. The defrost heat is thereby dammed in the housing of the heat exchange system. The defrosting flap can be a rigid, single-part or multi-part flap leaf or can comprise individual flap segments. The defrosting flap can be opened by the transport fluid of the fan or by a motor. The defrosting flap on which the heating lacquer layer can be arranged on one or both oppositely disposed sides of the defrosting flap, for example on the frame or on the flap segments or on the flap leaf, can transfer heat as thermal conduction onto the basic component to avoid frost from forming or it can output radiation heat, in particular from the flap leaf, inwardly into the housing. The heat exchange system, in particular the heat exchanger, is thereby irradiated with infrared heat and the layer of frost can be defrosted. In this respect, the arrangement of the heating lacquer layer on the defrosting flap at the air inlet of the housing is particularly advantageous because the frost layer is substantially built up at the air inlet at the heat exchanger. Heating bars in the heat exchanger can thus be dispensed with and the heat exchange system can be simplified.

In accordance with the invention, a defrosting device and/or a fan and/or a heat exchanger and/or a housing for a heat exchange system are furthermore proposed, wherein a heating lacquer layer is arranged on the defrosting device and/or on the fan and/or on the heat exchanger and/or on the housing, wherein the heating lacquer layer is electrically connected to a contact device for the electrical contacting of the heating lacquer layer, and wherein a layer of frost on the defrosting device and/or on the fan and/or on the heat exchanger and/or on the housing can be defrosted in the operating state of the heating lacquer layer.

It is thus advantageously possible to arrange the heating lacquer layer on the defrosting device and/or on the fan and/or on the heat exchanger and/or on the housing. Depending on the application or on the demand, it is therefore possible to make possible without any great technical effort a heating of a defrosting device and/or a fan and/or a heat exchanger and/or a housing of a heat exchange system, that is to defrost the layer of frost in the operating state. A replacement of the basic component can thus advantageously be carried out particularly simply in a maintenance case.

In accordance with the invention, the use of a heating lacquer for producing a heating lacquer layer on a heat exchange system and/or on a defrosting device and/or on a fan and/or on a heat exchanger and/or on a housing is furthermore proposed. As already mentioned, the application of the heating lacquer, that is the producing of the heating lacquer layer, can take place by a brush, by a spray gun, by means of lacquering rollers, by an automatic lacquering machine, by screen printing, by a dip process and/or by adhesively bonding a carrier film on which the heating lacquer layer is arranged. The heating lacquer used for producing the heating lacquer layer is electrically conductive and is free of carbon nanotubes and comprises a polymer and a semiconductor material.

The polymer can be acrylic, acrylic resin, epoxy resin, silicone or polyurethane. The heating lacquer can furthermore comprise acrylic resin as the polymer and tetrasodium diphosphate, calcium carbonate and graphite having a weight percentage of graphite of less than or equal to 20%.

The invention therefore in particular comprises the idea of arranging the electrical heating lacquer layer in the form of a heating lacquer on the heat exchange system and/or on the defrosting device and/or on the fan and/or on the heat exchanger and/or on the housing and to electrically contact them. If now an electric voltage is applied to the heating lacquer layer, an electric current flows in the heating lacquer layer. In this respect, the heating lacquer layer acts as an ohmic resistor, that is an electrical resistance heater is formed by the heating lacquer layer. The electric current that flows through the heating lacquer layer can advantageously be set via the degree of electric voltage, and thus via it an electric heating power. This electric heating power can advantageously be controlled or set as required by applying a corresponding electric voltage. A uniform heat transfer and a defrosting of the layer of frost can thus be made possible simply and inexpensively.

This therefore in particular means that a heat exchange system and/or a defrosting device and/or a fan and/or a heat exchanger and/or a housing and/or a defrosting flap is/are provided, wherein a heating lacquer layer is arranged thereon that heats the basic component in a simple manner or is configured as an infrared heat radiator, and wherein the layer of frost can be defrosted in a simple manner by thermal conduction in the operating state of the heating lacquer layer. A homogenous distribution of the heating lacquer layer and thus also a uniform heat transfer to the heat exchange system and to the basic components is furthermore advantageously possible. A large-surface infrared heat radiator can furthermore be formed and/or a large heating power can be provided and a heating lacquer layer can also be arranged on complex three-dimensional structures in an advantageous manner.

Further advantageous measures and preferred method routines result from the dependent claims.

BRIEF DESCRIPTION OF THE DRAWINGS

Referring now to the attached drawings which form a part of this original disclosure.

DETAILED DESCRIPTION OF THE EMBODIMENTS

Figure 1:
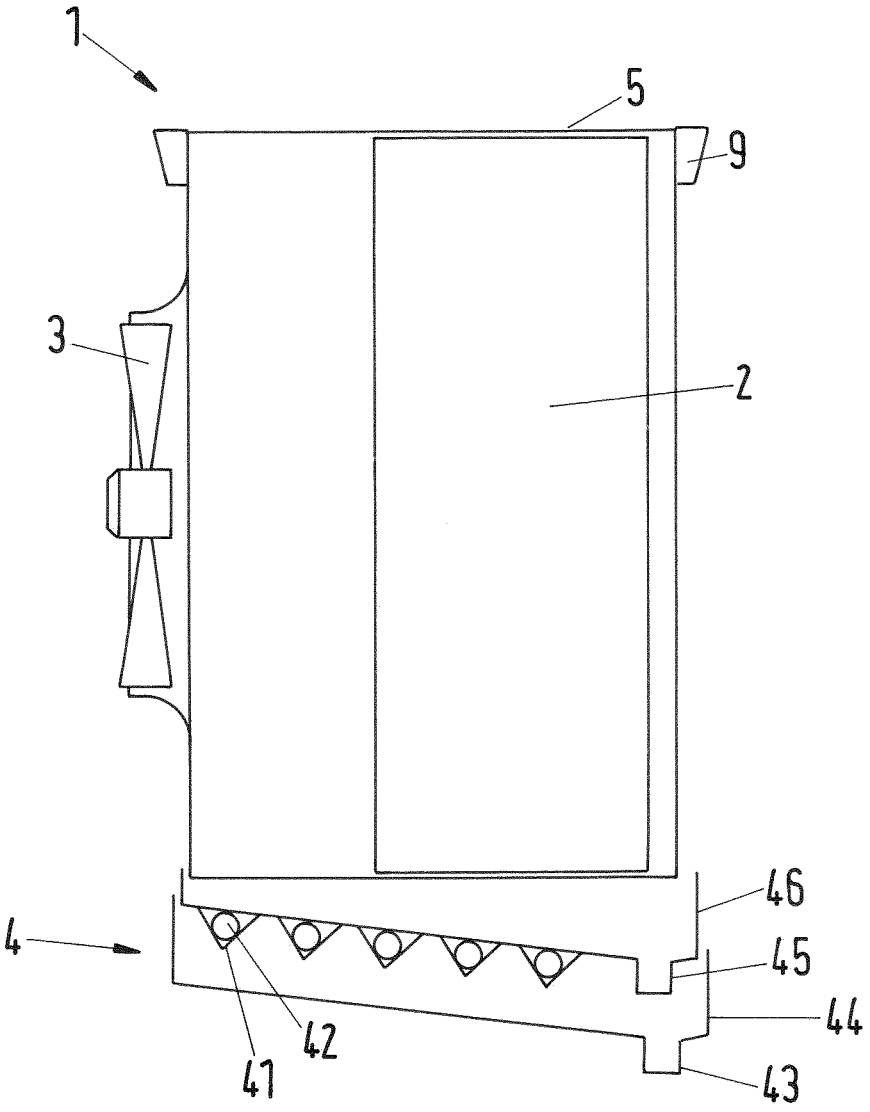
FIG. 1 is a heat exchange system known from the prior art.
Figure 2:
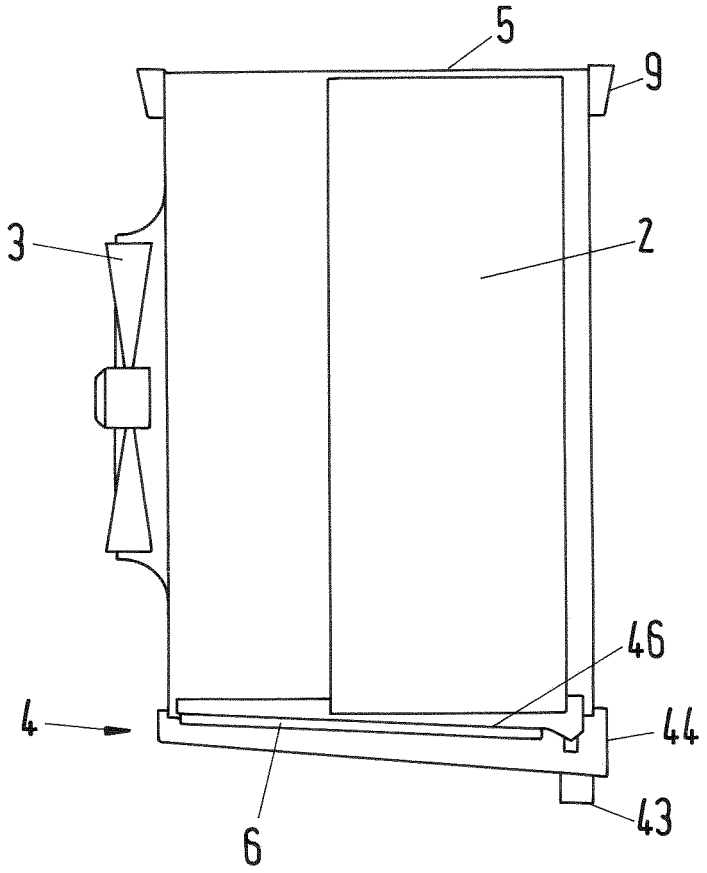
FIG. 2 is a first embodiment of a heat exchange system in accordance with the invention.

A schematic representation of a first embodiment of a heat exchange system 1 in accordance with the invention is shown in FIG. 2. FIG. 2 substantially corresponds to FIG. 1 so that only the differences will be looked at. A heating lacquer layer 6 is arranged at the defrosting device 4, more exactly at the first pan 45, wherein the heating lacquer layer 6 is electrically connected to a contact device (not shown, see FIG. 3) for the electrical contacting of the heating lacquer layer 6 and a layer of frost can be defrosted in the operating state of the heating lacquer layer 6. In this respect, an electric voltage is applied to the heating lacquer layer 6 so that an electric current flows in the heating lacquer layer. In this respect, the heating lacquer layer 6 acts as an ohmic resistor since the heating lacquer layer 6 is configured as an electrical resistance heater. The electric current that flows through the heating lacquer layer 6 can advantageously be set via the degree of electric voltage, and thus via it an electric heating power. The defrosting device 4 or the inner pan 46 is thereby advantageously heated a lot more evenly over the total surface coated with the heating lacquer layer than by the known measures. Due to the high radiation portion of the heating lacquer layer 6, not only the first pan 46 is heated, but rather adjacent basic components are also simultaneously heated, for example the second pan 44, by heat radiation.

Figure 3:
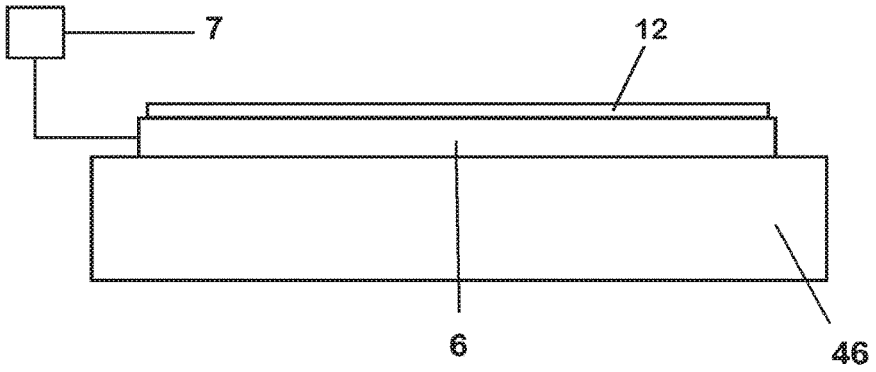
FIG. 3 is a first embodiment of a defrosting device in accordance with the invention.

A first embodiment of a defrosting device 4 in accordance with the invention is shown in FIG. 3. The heating lacquer layer 6 is arranged at the first pan 46. The heating lacquer layer 6 can be an electrically conductive carbon nanotube-free heating lacquer layer 6. The heating lacquer layer 6 can comprise a polymer and a semiconductor material. A contact device 7 is furthermore shown that is electrically connected to the heating lacquer layer 6 to electrically contact it. It is thus advantageously made possible, for example, to apply an electric voltage to the heating lacquer layer 6 by the contact device 7 so that an electric current flows through the heating lacquer layer 6. This electric current is then converted into heat that is transferred by thermal conduction to a basic component and/or is led off to an environment in the form of thermal radiation, whereby a layer of frost on the first pan 46 can be defrosted. Advantageously, a very uniform thermal transfer can be achieved and an even infrared spectrum can be steered by varying the electric voltage or the power consumption respectively. Temperatures from 0° C. to 400° C. are thereby in particular advantageously achievable, wherein, for example, different voltages or voltage levels can be applied in the form of DC voltage or AC voltage. A target temperature can in this respect advantageously be reached within a few seconds as a rule. A protective layer 12 can be arranged on the heating lacquer layer 6.

The heating lacquer layer 6 in particular advantageously has a positive temperature coefficient (PTC). This means that with an increasing temperature, an internal conductive resistance also increases, whereby an upper limit is set for the achievable temperature. This advantageously results in a particularly safe operation of the heating lacquer layer 6. A further additional safety limit can in particular advantageously be set via the chemical composition of a heating lacquer that is used for the heating lacquer layer 6, for example via a suitable selection of the polymer and/or of the semiconductor material. Furthermore, the effect of the positive temperature coefficient can be used as an indirect temperature sensor since the resistance value as a rule depends on the instantaneous temperature of the heating lacquer layer 6, whereby there is advantageously no need for further temperature sensors.

Figure 4:
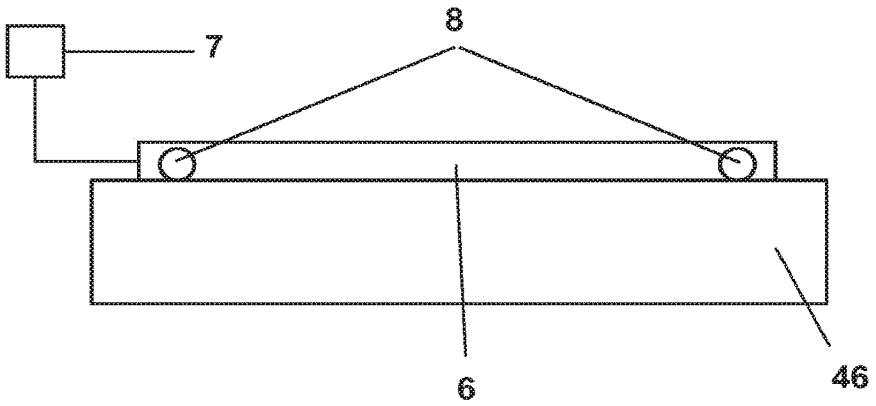
FIG. 4 is a second embodiment of a defrosting device in accordance with the invention.

A schematic representation of a second embodiment of a defrosting device 4 in accordance with the invention is shown in FIG. 4. FIG. 4 substantially corresponds to FIG. 3 so that only the differences will be looked at. The contact device 7 comprises two electric conductors 8 arranged next to one another, with the heating lacquer layer 6 being at least partly arranged between the electric conductors 8. The electric conductors 8 are arranged at the second pan 46 and extend substantially in parallel with one another. The heating lacquer layer 6 that touches or contacts the electric conductors 8 is formed between the two electric conductors 8 so that an electric contacting of the heating lacquer layer 6 is achieved via them. Provision can be made in an embodiment, not shown, that at least one of the electric conductors 8, preferably all the electrical conductors, is/are replaced by a wire, by a braid by a metal film, by a metal band, or by a metal sheet.

The invention claimed is:

1. A heat exchange system comprising:

a heat exchanger configured to exchange heat between a transport fluid and a heat transfer fluid flowing through the heat exchanger;

a fan configured and arranged such that the transport fluid is capable of being transported through the heat exchanger;

a defroster configured to defrost a layer of frost and comprising a pan; and a housing at which at least the heat exchanger and the fan are arranged, a heating lacquer layer arranged on at least one of the fan, the defroster, the pan, and the housing, the heating lacquer layer being electrically connected to a contact for electrical contact with the heating lacquer layer, and when the layer of frost is on at least one of the heat exchanger, the fan, the defroster, the pan, and the housing, the layer of frost is able to be defrosted when the heating lacquer layer is in an operating state.

2. The heat exchange system in accordance with claim 1, wherein the heating lacquer layer is electrically conductive, is free of carbon nanotubes and comprises a polymer and a semiconductor material.

3. The heat exchange system in accordance with claim 2, wherein the polymer is acrylic, acrylic resin, epoxy resin, silicone or polyurethane.

4. The heat exchange system in accordance with claim 2, wherein the heating lacquer layer comprises acrylic resin as the polymer and tetrasodium diphosphate, calcium carbonate and graphite having a weight percentage of graphite of less than or equal to 20%.

5. The heat exchange system in accordance with claim 1, wherein the contact comprises two electric conductors arranged adjacent one another, with the heating lacquer layer being arranged at least partly between the electric conductors.

6. The heat exchange system in accordance with claim 5, wherein the electric conductors comprise a wire, a braid, a metal mesh, a metal band, a metal film or a metal sheet.

7. The heat exchange system in accordance with claim 1, further comprising a protective layer arranged on the heating lacquer layer.

8. The heat exchange system in accordance with claim 1, further comprising at least one of a reflector layer configured to reflect infrared radiation and an insulating layer configured for thermal insulation is formed between at least one of the heat exchanger, the fan, the defroster, and the housing, and the heating lacquer layer.

9. The heat exchange system in accordance with claim 1, wherein a conductive layer for transferring the heat by means of thermal conduction and/or for electrical insulation is formed between the at least one of the heat exchanger, the fan, the defroster, and the housing and the heating lacquer layer.

10. The heat exchange system in accordance with claim 1, further comprising a defroster flap and when the layer of frost is on the defroster flap, the layer of frost is able to be defrosted in the operating state of the heating lacquer layer.

11. The defroster for the heat exchange system in accordance with claim 1, the defroster comprising the heating lacquer layer arranged on the defroster and the heating lacquer layer being electrically connected to the contact for electrical contact with the heating lacquer layer, and when the layer of frost is disposed on the defroster, the layer of frost is capable of being defrosted in the operating state of the heating lacquer layer.

12. The fan for the heat exchange system in accordance with claim 1, the fan comprising:

the heating lacquer layer arranged on the fan and the heating lacquer layer being electrically connected to the contact for electrical contact with the heating lacquer layer, and when the layer of frost is disposed on the fan, the layer of frost is capable of being defrosted in the operating state of the heating lacquer layer.

13. The housing for the heat exchange system in accordance with claim 1, the housing comprising:

the heating lacquer layer arranged on the housing and the heating lacquer layer being electrically connected to the contact for electrical contact with the heating lacquer layer, and when the layer of frost is disposed on the housing, the layer of frost is capable of being defrosted in the operating state of the heating lacquer layer.

14. A method comprising:

operating a heating lacquer for manufacturing the heating lacquer layer on the heat exchange system in accordance with claim 1.

15. A method comprising:

operating a heating lacquer for manufacturing the heating lacquer layer on the defroster in accordance with claim 11.

16. A method comprising: operating a heating lacquer for manufacturing the heating lacquer layer on the fan in accordance with claim 12.

17. A method comprising:

operating a heating lacquer for manufacturing the heating lacquer layer on the housing in accordance with claim 13.

18. The heat exchange system in accordance with claim 7, wherein the protective layer is at least one of an insulating lacquer, a glass fiber reinforced plastic and a protective film.

19. The heat exchange system in accordance with claim 1, wherein the heating lacquer layer is arranged on the pan.

* * * * *